US005385182A

United States Patent [19]

Dyer

[11] Patent Number: 5,385,182

[45] Date of Patent: Jan. 31, 1995

[54] FUEL NOZZLE RETAINER SAFETY BREAKAWAY DEVICE

[76] Inventor: Bobby R. Dyer, 50 Sunny Ridge La., Dayton, Ohio 45429

[21] Appl. No.: 241,400

[22] Filed: May 11, 1994

[51] Int. Cl.[6] ..... B67C 3/00

[52] U.S. Cl. ..... 141/392; 141/98; 141/312

[58] Field of Search ..... 141/312, 392, 311 R, 141/391, 98

[56] References Cited

U.S. PATENT DOCUMENTS

| | | | |
|---|---|---|---|
| 998,352 | 7/1911 | Kublin . | |
| 2,906,302 | 9/1959 | Martin | 141/392 |
| 3,814,147 | 6/1974 | Lindberg | 141/392 X |
| 3,840,055 | 10/1974 | Wostl et al. | 141/392 X |
| 3,967,660 | 7/1976 | Russell | 141/392 X |
| 4,003,415 | 1/1977 | Lasater | 141/392 X |
| 4,040,458 | 8/1977 | Hansel | 141/392 |
| 4,187,913 | 2/1980 | Wilcox | 169/51 |
| 4,354,536 | 10/1982 | Moss | 141/383 |
| 4,557,302 | 12/1985 | Sunderhaus | 141/392 X |
| 4,913,201 | 4/1990 | Lucero et al. | 141/334 |
| 5,236,023 | 8/1993 | Mohr | 141/312 |

*Primary Examiner*—Ernest G. Cusick
*Attorney, Agent, or Firm*—R. William Graham

[57] ABSTRACT

The present invention is directed to a fuel nozzle retainer safety breakaway device comprising a clamp clamped to the nozzle, a latch pivotally connected to the clamp and structure for disconnecting the latch from the clamp at a predetermined force less than that required to break the nozzle from the dispenser.

11 Claims, 1 Drawing Sheet

FUEL NOZZLE RETAINER SAFETY BREAKAWAY DEVICE

BACKGROUND OF THE INVENTION

This invention relates to fluid dispensing nozzles and particularly to a fuel nozzle retainer safety breakaway device attached to a fuel dispensing nozzle for retaining the nozzle in a tank during fueling of the tank and designed for breaking away from the nozzle and preventing harm thereto which occurs, for example, during drive-offs. More particularly, during refueling of diesel tanks on semi-trucks, the operator will often place the nozzle within the tank and depart from truck for an extended period of time while the tanks are being refueled. Two problematic situations have been noticed. First, the nozzle becomes dislodged from the tank dispensing large amounts of fuel onto the ground creating an environmental clean-up problem. Second, not infrequently, the operator will forget to remove the nozzle from the tank after refueling and depart from the dispensers pulling the nozzle and hose entirely off the dispensing mechanism and, in some cases, causing severe damage to the dispenser itself. For these reasons, there remains a need to provide a safety mechanism which addresses these problems which occur during refueling. The present invention is believed to solve these problems.

Prior devices have thus far addressed only the issue of providing a retaining mechanism for retaining or locking the fuel nozzle into a tank. Such devices are relatively cumbersome, expensive or problematic in their ability to retrofit the nozzle and hang on the dispensers while in nonuse. The present invention also addresses this problem and provides a solution thereto.

SUMMARY OF THE INVENTION

It is an object of the present invention to provide a fuel nozzle retainer safety breakaway device which overcomes the disadvantages of fuel nozzle retainers known heretofore.

It is a further object of the present invention to provide a fuel nozzle retainer safety breakaway device for use on fuel nozzles to protect the fuel nozzle and dispenser during accidental drive-offs.

It is still a further object of the present invention to provide a fuel nozzle retainer which is less cumbersome, expensive and useful on existing nozzles and dispensers.

Accordingly, the present invention is directed to a fuel nozzle retainer safety breakaway device comprising a clamp clamped to the nozzle, a latch pivotally connected to the clamp and means for disconnecting the latch from the clamp at a predetermined force less than that required to break the nozzle from the dispenser.

The disconnecting means includes a shearable bearing pin connected to the clamp about which the latch pivots. The latch is of a length substantially that of the fuel nozzle and has a hooked end for latching inside a tank and an end having a bore surface through which the pin extends.

DETAILED DESCRIPTION OF THE PREFERRED EMBODIMENT

Figure 1:
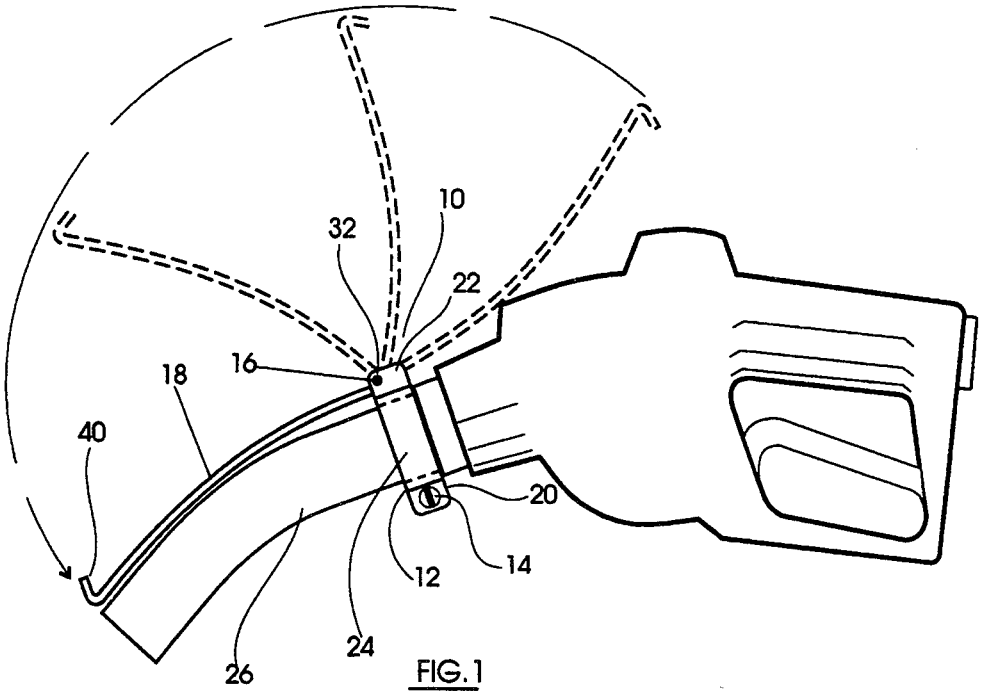
FIG. 1 is a side view of the fuel nozzle retainer safety breakaway device of the present invention on a fuel nozzle.

Referring to the drawings, the fuel nozzle retainer safety breakaway device is generally designated by the numeral 10 and is to be used at service stations on nozzles for filling tanks with diesel fuel. The device 10 is relatively inexpensive, useful, and adaptable to wide variety of dispensers and tanks conventionally used today. The device 10 includes a clamp 12, means 14 for tightening the clamp 12, shear pin 16 and safety latch 18.

The clamp 12 is of a generally U-shaped configuration having connectable ends 20 oppositely disposed from an operative portion 22 of the clamp 12. Extending from the operative portion 22 to the connectable ends 20 are a pair of oppositely facing arcuate portions 24 shaped to fit about a nozzle 26. The ends 20 each have a bore surface 28 which are co-axial with one another. The operative portion 22 includes a notched surface portion 30 and co-axial bore surfaces 32. Fastening means 14 can include, for example, a screw and bolt. The screw is threaded through the bore surfaces 28 to the bolt in order to draw the arcuate portions 24 of the clamp 12 into a tightly fixed position on the nozzle 26.

The shear pin 16 extends through co-axial bore surfaces 32 and a bore surface 34 of an end 36 of latch 18. The shear pin 16 is designed to withstand between 220 to 300 lbs. of pressure or that amount of pressure generally less than the required amount to pull the nozzle or hose from a dispenser unit. The notch surface 30 is of a sufficient depth to permit the latch 18 to pivot approximately 180 degrees. The co-axial bore surfaces 32 and shear pin 16 are positioned adjacent an outer most edge 38 to allow the latch 18 to be readily broken away from the clamp 12 and, thus, the nozzle 26 upon reaching the predetermined pressure load.

Figure 2:
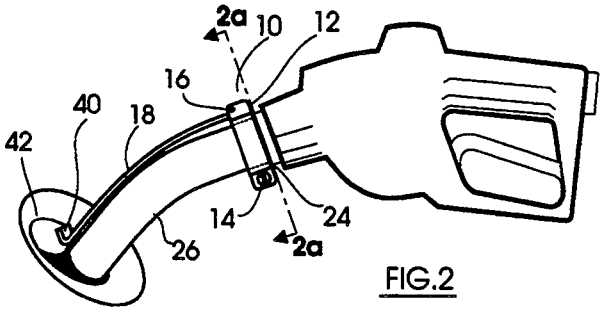
FIG. 2 shows a view of the fuel nozzle retainer safety breakaway device on a fuel nozzle with a safety latch latching inside of a tank.
Figure 2A:
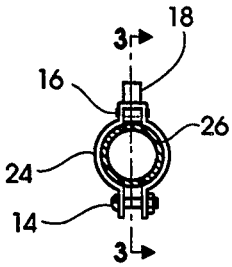
FIG. 2*a* is a part cross-sectional view taken along line 2—2 of the fuel nozzle retainer safety breakaway device and nozzle shown in FIG. 2.
Figure 4:
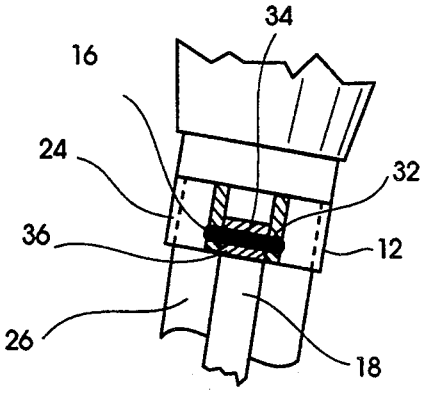
FIG. 4 is a cross-sectional view taken along line 4—4 of FIG. 3 of the fuel nozzle retainer safety breakaway device and nozzle.
Figure 3:
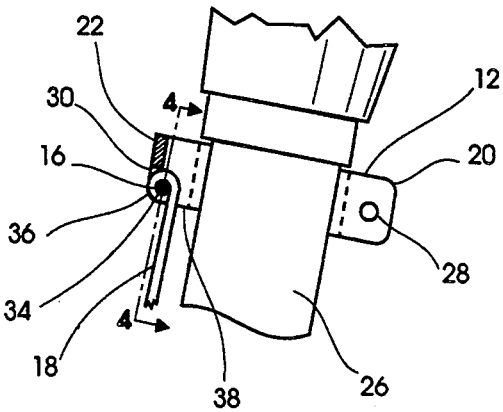
FIG. 3 is a part cross-sectional view taken along line 3—3 of the fuel nozzle retainer safety breakaway device and nozzle shown in FIG. 2*a;*

The latch 18 terminates in a hook portion 40. When the nozzle 26 is inserted into a dispenser, the latch 18, by virtue of its pivotability and gravitational forces, swings to a position adjacent the upper portion of the handle of the nozzle as shown in FIG. 1. This allows for insertion of the nozzle 26 into the dispenser without the retainer safety breakaway device 10 causing inhibition in its placement. As the nozzle 26 is withdrawn from the dispenser and moved into a downward position as occurs during refueling, the latch 18 swings downward along side the nozzle 26, as shown in FIG. 2. The nozzle 26 and latch 18 are then inserted into a tank 42 and can be canted so that the hook 40 catches the inside of the tank 42. The latch 18 is preferably of a length approximate that of the nozzle 26 so that the clamp 12 and latch 18 are sufficiently removed from a tip of the nozzle 26 when inserted into a dispenser nozzle holder. The latch 18 is of a width to provide desired stability in the latching of the nozzle 26 to the tank 42.

While the present invention has been set forth in the above preferred embodiment, it will be understood by those skilled in the art that many modifications, derivations and improvements can be readily made thereon. Accordingly, the present invention and claims appended hereto should be accorded the full scope of protection of such modifications, derivations and improvements.

What is claimed is:

1. A fuel nozzle retainer breakaway safety device for use on a fuel nozzle connected to a fuel dispenser, comprising:

a clamp clamped to the nozzle;

a latch pivotally connected to said clamp; and means for disconnecting said latch from said clamp at a predetermined force less than that required to break the nozzle from the dispenser.

2. The device of claim 1, wherein said latch has a first end which pivotally connects to said clamp and an elongated portion extending from said first end and terminating in a second hook-shaped end.

3. The device of claim 2, wherein said disconnecting means pivotally connects said clamp and said latch.

4. The device of claim 1, wherein said disconnecting means includes a shearable bearing pin connected to said clamp and about which an end of said latch is pivotally connected.

5. The device of claim 4, wherein said latch has a bore surface through said end in which said shearable bearing pin extends therethrough.

6. The device of claim 1, wherein said clamp is generally U-shaped having a pair of connectably tightenable ends, an operative portion wherein said shearable means is operably connected, and a pair of actuate portions, each said arcuate portion extending from said operative portion and terminating in one of said tightenable ends.

7. The device of claim 1, wherein said latch is of a length and configuration to extend along the length of the nozzle.

8. A fuel nozzle retainer breakaway safety device for use on a fuel nozzle connected to a fuel dispenser, comprising:

a clamp clamped to the nozzle;

a latch having a first end pivotally connected to said clamp, an elongated portion extending from said first end and terminating in a second hook-shaped end; and means for shearing said latch from said clamp at a predetermined force less than that required to break the nozzle from the dispenser.

9. The device of claim 8, wherein said shearing means includes a shearable bearing pin connected to said clamp and about which said first end of said latch is pivotally connected.

10. The device of claim 9, wherein said latch has a bore surface through said end in which said shearable bearing pin extends therethrough.

11. The device of claim 8, wherein said clamp is generally U-shaped having a pair of connectably tightenable ends, an operative portion wherein said shearing means is operably connected, and a pair of actuate portions, each said arcuate portion extending from said operative portion and terminating in one of said tightenable ends.

* * * * *